US011761270B2

(12) United States Patent
Stachowiak, Jr.

(10) Patent No.: US 11,761,270 B2
(45) Date of Patent: Sep. 19, 2023

(54) OPERATING TOOL FOR AN ARTIFICIAL LIFT SYSTEM

(71) Applicant: Weatherford Technology Holdings, LLC, Houston, TX (US)

(72) Inventor: John Edward Stachowiak, Jr., Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 240 days.

(21) Appl. No.: 17/159,362

(22) Filed: Jan. 27, 2021

(65) Prior Publication Data

US 2022/0235616 A1 Jul. 28, 2022

(51) Int. Cl.

| | |
|---|---|
| ***E21B 17/06*** | (2006.01) |
| ***E21B 17/02*** | (2006.01) |
| ***E21B 43/12*** | (2006.01) |
| ***F04B 47/02*** | (2006.01) |
| ***F04B 53/14*** | (2006.01) |

(52) U.S. Cl.
CPC ..... *E21B 17/06* (2013.01); *E21B 17/021* (2013.01); *E21B 43/127* (2013.01); *F04B 47/026* (2013.01); *F04B 53/144* (2013.01)

(58) Field of Classification Search
CPC ..... E21B 17/06; E21B 31/18; E21B 43/127
See application file for complete search history.

(56) References Cited

U.S. PATENT DOCUMENTS

| | | | | |
|---|---|---|---|---|
| 1,645,428 | A | | 10/1927 | Hosmer |
| 2,161,501 | A | | 6/1939 | Blackmon |
| 2,671,682 | A | | 3/1954 | Page |
| 2,921,364 | A | | 1/1960 | Bloudoff |
| 2,978,048 | A | * | 4/1961 | Walker ..... E21B 17/06 285/402 |
| 3,168,340 | A | | 2/1965 | Howard |
| 3,219,373 | A | | 11/1965 | Sutliff |
| 3,275,354 | A | | 9/1966 | Sutliff et al. |
| 3,366,408 | A | | 1/1968 | Scarborough et al. |
| 3,455,248 | A | | 7/1969 | Sutton et al. |
| 4,921,407 | A | | 5/1990 | Ponder |
| 9,784,055 | B1 | | 10/2017 | Bair |
| 10,273,762 | B2 | | 4/2019 | Stachowiak et al. |
| 2013/0140029 | A1 | | 6/2013 | Sullivan |
| 2014/0110130 | A1 | | 4/2014 | Lembcke |

(Continued)

OTHER PUBLICATIONS

Harbison-Fisher, "Rod Pumps for High-vol. Fluid Production," Product Brochure, undated, obtained from www.red-adesigngroup.com on Sep. 30, 2014.

(Continued)

*Primary Examiner* — Cathleen R Hutchins
(74) *Attorney, Agent, or Firm* — Cabello Hall Zinda, PLLC

(57) ABSTRACT

An operating tool for an artificial lift system includes a housing having a key slot. The operating tool further includes at least one biasing member disposed in the housing. The operating tool further includes a key including a key head having a key profile, wherein the key head is remove from the slot when aligned with the key slot. The operating tool further includes a cam including a cam profile, wherein the cam is disposed in the housing and biased toward the slot by the at least one biasing member, wherein the cam profile is configured to engage the key profile to align the key head with the key slot.

14 Claims, 12 Drawing Sheets

(56) References Cited

U.S. PATENT DOCUMENTS

| | | | | |
|---|---|---|---|---|
| 2014/0224478 | A1* | 8/2014 | Hansen | E21B 23/04 166/377 |
| 2016/0208564 | A1 | 7/2016 | Stachowiak | |
| 2017/0248245 | A1 | 8/2017 | Ford | |
| 2018/0283146 | A1 | 10/2018 | Stachowiak, Jr. | |

OTHER PUBLICATIONS

Don-Nan Pump & Supply, "On-Off Tool," Product Brochure, undated, obtained from www.don-nan.com on Aug. 29, 2014.
Stachowiak, J. et al., "Presentation—On-Off tool," PowerPoint Presentation available from www.alrdc.com, copyright 2012.
Western Oilfield Specialties Corp., "Browning On-Off Tool," Brochure, undated.
Roderick, R. et al., "Uses, Operation, Design Considerations and Load Rating of On-Off Tool," undated.
Don-Nan Pump & Supply, "On-Off Tool," Product Brochure, undated.
Weatherford, "On-Off Tool," Product Brochure, copyright 2012.
Office Action in counterpart CA appl. 2912508, dated Oct. 11, 2016, 3-pgs.
Q2 Artificial Lift Services; Q2-Latch on-Off Tool Assembly, Product Brochure, pp. 1-2.
Weatherford, "T-2 On-Off Tool," Product Brochure, copyright 2011 pp. 1-5.
International Search Report and Written Opinion in related application PCT/US2021/072802 dated Mar. 7, 2022.

* cited by examiner

OPERATING TOOL FOR AN ARTIFICIAL LIFT SYSTEM

BACKGROUND

Field

Embodiments of the present disclosure generally relate to an operating tool for an artificial lift system.

Description of the Related Art

A conventional oil well includes a cased wellbore with at least one string of tubing extending downwardly through the casing into the oil or other petroleum fluid contained in the subsurface mineral formation to be produced. The casing is perforated at the level of the production zone to permit fluid flow from the formation into the casing, and the lower end of the tubing string is generally open to provide entry for the fluid in the tubing.

Many hydrocarbon wells are unable to produce at commercially viable levels without assistance in lifting the formation fluids to the earth's surface. In some instances, high fluid viscosity inhibits fluid flow to the surface. More commonly, formation pressure is inadequate to drive fluids upward in the wellbore. In the case of deeper wells, the hydrostatic head that acts downwardly against the formation inhibits the unassisted flow of production fluid to the surface.

In many instances, artificial lift may be required to raise the produced fluids to the surface. A common approach for urging production fluids to the surface uses a mechanically actuated, positive displacement pump driven from the surface by a pumping unit, such as a pump jack connected to the pump by a sucker rod string. Reciprocal movement of the sucker rod string induces reciprocal movement of the pump for lifting production fluid to the surface.

For example, an artificial lift system 20 is shown in FIG. 1A to produce production fluid from a wellbore 10. The surface casing 12 hangs from the surface and has a liner casing 14 hung therefrom by a liner hanger 16. Production fluid F from the formation 11 outside the cement 13 can enter the liner 14 through perforations 17. To convey the fluid, production tubing 26 extends from a wellhead 28 downhole, and a packer 15 seals the annulus between the production tubing 26 and the liner 14. At the surface, the wellhead 28 receives production fluid and diverts it to a flow line 29.

The production fluid F may not produce naturally to reach the surface so operators use the artificial lift system 20 to lift the fluid F. The artificial lift system 20 has a surface pumping unit 22, a sucker rod string 24, and a downhole pump 30. The surface pumping unit 22 reciprocates the sucker rod string 24, and the reciprocating sucker rod string 24 operates the downhole pump 30. The pump 30 has internal components attached to the sucker rod string 24 and has external components positioned in a pump-seating nipple 31 near the producing zone and the perforations 17.

As best shown in the detail of FIG. 1B, the pump 30 has a barrel 40 with a plunger 32 movably disposed therein. The plunger 32 has a plunger rod 33 attached to it, which connects to the sucker rod string 24 of the artificial lift system 20. The plunger rod 33 is of sufficient length so that the plunger rod 33 will extend through the upper end of the barrel 40 even at the bottom of the plunger's stroke.

The barrel 40 has a standing valve 42, and the plunger 32 has a traveling valve 34. For example, the standing valve 42 disposed in the barrel 40 can be a check valve having a ball 44 and seat 46. Similarly, the traveling valve 34 can also be a check valve (e.g., one-way valve) having a ball 36 and seat 38.

As the surface pumping unit 22 reciprocates, the sucker rod string 24 reciprocates in the production tubing 26 and moves the plunger 32. The plunger 32 moves the traveling valve 34 in reciprocating upstrokes and downstroke. During an upstroke, the traveling valve 34 is closed (i.e., the upper ball 36 seats on upper seat 38). In some instances, the hydraulic force acting on the plunger 32 during the upstroke may exceed 30,000 pounds Movement of the closed traveling valve 34 upward reduces the static pressure within the pump chamber 45*b* (the volume between the standing valve 42 and the traveling valve 34 that serves as a path of fluid transfer during the pumping operation). This, in turn, causes the standing valve 42 to unseat so that the lower ball 44 lifts off the lower seat 46. Production fluid F is then drawn upward into the chamber 45*b*.

Ultimately, the produced fluid F is delivered by positive displacement of the plunger 32, out passages 45*a* in the barrel 40. The moved fluid then moves up the wellbore 10 through the production tubing 26 to the wellhead 28. The production fluid is diverted from the wellbore via the flow line 29.

On the following downstroke, the plunger 32 moves downward in barrel 40 by the reciprocation applied by the pumping unit 22 via the sucker rod string 24. The weight of the sucker rod string 24 pushes the plunger 32 through the fluid in the barrel 40. The standing valve 42 closes as the standing ball 44 seats upon the lower seat 46. At the same time, the traveling valve 34 opens so fluids previously residing in the chamber 45*b* can pass through the valve 34 and into the plunger 32. The upstroke and down stroke cycles are repeated, causing fluids to be lifted upward through the wellbore 10 and ultimately to the earth's surface.

At some point, it may become necessary to disconnect or connect the sucker rod string 24 with the pump 30, such as in an oversize tubing pump installation where the pump plunger 32 is installed separately from the sucker rod string 24. In an insert pump or a standard tubing pump 30, the plunger 32 or other portions of the pump 30 may become sanded in, corroded, or otherwise difficult to remove from the wellbore 10. Typically, the sucker rod string 24 is not robust enough to transmit the necessary force required to remove stuck components without damaging the sucker rod string 24 for later use. In other instances, it may be desirable the remove only the sucker rod string 24 simply to adjust and maintain the sucker rod string 24 without removing either the plunger 32 or the barrel 40.

For these reasons, it may be desirable to use an on-off tool 50 on the sucker rod string 24, as shown in FIGS. 1A-1B. The on-off tool 50 must be able to disconnect the sucker rod string 24, but must also be able to be reconnected as desired by the operators. Usually, the on-off tool 50 is installed on the sucker rod string 24 close to the plunger 32.

To connect the sucker rod string 24 to the pump 30 disposed downhole, the on-off tool 50 connects automatically to the pump 30 as the sucker rod string 24 is lowered. The on-off tool 50 is rotated to the correct alignment position and uses the sucker rod string's weight to complete the connection. To disconnect the sucker rod string 24 from the pump 30, the on-off tool 50 is unlocked and disconnected by setting the pump 30 at the bottom of its stroke and turning the sucker rod string 24 in the release direction of the tool 50 while slowly picking up the sucker rod string 24. The on-off tool 50 can have either right-release or left-release direction based on the application and other equipment used.

FIG. 2A-2D illustrates a prior art on-off tool 50. FIG. 2A illustrates the tool 50 with the key 70 disconnected from the housing 52. The tool 50 includes a housing 52 having a top fitting 54 with a pin connector for attaching to a sucker rod string 24 with a coupling 25. The housing 52 includes a key slot 60 and a seat 62. The tool 50 further includes a cam 58 disposed inside the housing 52. The cam 58 can move axially/longitudinally against the bias of one or more springs 56. Fixed pins 59 on the housing 52 can ride in slots of the cam 58 to keep the cam 58 from rotating within the housing 52 as the cam 58 moves longitudinally. The tool 50 further includes a key 70 having a head 72 at one end and a connector 71, such as a box, at the other end to connect the key 70 to the plunger rod 33 of the pump 30.

The housing 52 includes a clutch tab 53 and an end shoulder 57. The key 70 includes a tab 73 and a shoulder 75. The engagement of the clutch tab 53 with the tab 73 limits the rotation of the housing 52 relative to the key 70 to align the key 70 relative to the housing 52. During a disconnecting operation of the tool 50, the engagement of the clutch tab 53 with the tab 73 aligns the oblong head 72 with the slot 60 such that the key 70 may be withdrawn from the housing 52.

The on-off tool 50 incorporates a cam-type system using the internal cam 58 under the spring's 56 force and being actuated (in a longitudinal direction) by rotating the cam 58 and the housing 52 relative to the key 70. This imparts torque, which requires the guide pins 59 to counteract the torque and to keep the cam 58 from rotating in the housing 52.

When connecting the key 70 to the housing 52 downhole, the housing 52 may be lowered onto the key 70 so that the housing 52 interfits and interlocks with the key 70. The connection is accomplished by the weight of the sucker rod string 24 above the housing 52, by a rotation of the sucker rod string 24 that causes relative rotary motion between the housing 52 and the key 70 to misalign the key head 72 with the slot 60, and by the locking action of the key's head 72 to the internal mechanism of the tool 50.

In particular, the key 70 inserts in a key slot 60 in the housing 52 so the key 70 in a locked position can engage a seat 62 and transmit the tensile forces exerted by the pumping unit 22 on the up stroke. The shoulder 75 of the key cooperates with the shoulder 57 of the housing 52 to transmit any compressive forces of the tool 50 to the plunger rod 33 and ultimately the plunger 32.

FIGS. 2A-2C illustrates a connection operation of the on-off tool 50. Initially, the key 70 is coupled to the plunger rod 33 of the pump 30 disposed downhole in the production tubing 26. The housing 52 is connected to the sucker rod string 24 using the coupling 25 and is lowered down the tubing string to the pump 30. As shown in FIG. 2A, the housing 52 is separated from the key 70.

The housing 52 is lowered relative to the key 70. The head 72 of the key 70 has an oblong cross-section. If the key 70 is not properly aligned with the opening for the slot 60, then relative rotation between the housing 52 and key 70 can align the head 72 with the slot 60. Eventually, the housing 52 inserts over the key 70, which passes through the slot 60 in the housing 52. Passing up through the housing 52, the key 70 pushes the cam 58 against the bias of the spring 56, as shown in FIG. 2B.

To complete the connection, the sucker rod string 24 is rotated to rotate the housing 52 to misalign the head 72 with the slot 60. As the housing 52 is rotated, the cam 58 cooperates with the oblong head 72 and the spring 56 push the cam 58 over the head 72. FIG. 2C illustrate the tool 50 with the key 70 locked in the housing 52. Reciprocating of the sucker rod string 24 can now operate the pump 30 while the on-off tool 50 holds the sucker rod string 24 to the plunger rod 33.

To disconnect the tool 50, sucker rod string 24 is rotated in a direction opposite of the direction of connecting the tool 50 to unlock the key 70 from the housing 52. For example, the sucker rod string 24 is rotated in a clockwise direction to rotate the housing 52 relative to the key 70. The cam 58 rotates with the housing 52, and the profile of the cam 58 slides along the key head 72. As the cam 58 slides along the key head 72, the cam 58 is forced to travel longitudinally within the housing 52 and thus compresses the spring 56. Rotation of the housing 52 relative to the key 70 is limited by the engagement of the clutch tab 53 with the tab 73. When the clutch tab 53 and tab 73 are engaged, the head 72 is aligned with the slot 60. The sucker rod string 24 can be lifted to withdraw the key 70 from the housing 52.

During use, for example, the key 70 and housing 52 are subjected to deformation due to downstroke and upstroke impacts. The housing's seat 62 deforms due to broaching of the key head 72, and the shoulder 75 and tab 73 of the key head 72 deforms from impact wear with the housing 52 as the pump 30 is stroked. Likewise, the shoulder 57 and clutch tab 53 is subjected to brinelling due to the impact with the key 70 as the pump 30 is stroked.

As wear progresses during use, the gap or play between the shoulder 57 and the shoulder 75 increases and produces a slide hammer effect as the play between the components progressively increases as wear occurs. The increased play between the housing 52 and the key 70 further beats the seat 62 against the head's bearing surface 75. Eventually, the key head 72 can break off due to impacts. Further, the wear of the clutch tab 53 and tab 73 may reduce their effectiveness in aligning the key head 72 with the slot 60 when disconnecting the tool. During high stroke speeds, the on-off tool 50 can also become disconnected, or the key 70 becomes unlocked from the housing 52, due to dynamic forces (axial loads and torque) imparted through the sucker rod string 24 coupled with low spring force on the cam 58.

The coil spring 56 biases the cam 58 toward the key head 72 to complete the connecting sequence. However, the coil spring 56 may fail to provide enough axial load needed to keep the tool 50 connected in higher speed pumping applications where the dynamics of the sucker rod string 24 can cause the key 70 to overcome the rotational torque needed to compress the coil spring 56, causing the tool 50 to disconnect.

FIGS. 3A-3C illustrates another exemplary conventional on-off tool 50 similar to the on-off tool disclosed in U.S. Pat. No. 10,273,762, which is hereby incorporated by reference. A cam 58 in the housing 52 can move longitudinally against the bias of one or more springs 56, such as a plurality of disk springs. Rather than using fixed pins, the tool 50 includes guide bearings 59 that correspond to a slot in the cam 58 to keep the cam 58 from rotating inside the housing 52. The guide bearings 59 are elongate pins disposed longitudinally between the cam 58 and the interior of the housing 52. Opposite the housing 52, the tool 50 similarly includes a key 70 having a head 72. The key 70 includes a connector 71 to facilitate the connection of the key 70 to the plunger rod 33 of a pump 30. The tool 50 can be connected or disconnected in a similar manner to the tool shown in FIGS. 2A-2D.

The cam 58 has two forks 58*f* each having a cam profile. The cam profile is a helical progression with a gradual slope that corresponds to the profile of the key head 72. The key head 72 interfits with the cam 58 when the key 70 is locked within the housing 52. During the insertion of the key 70 into the housing 52, the profile of the head 72 engages of profile of the cam 58, which causes the cam 58 to travel within the housing 52 and compress the springs 56.

As shown in FIGS. 3A-3C, the tool 50 does not include an external clutch, in that the housing 52 and key 70 do not have corresponding clutch tabs. Instead, the key 70 has a uniform shoulder 75 that corresponds to a uniform shoulder 57 of the housing 52. By omitting the clutch tabs, the area of contact between the shoulders 57, 75 is increased, which increases the longevity of the tool by decreasing the progression of the wear that occurs during the use of the tool 50.

To disconnect the tool 50 shown in FIGS. 3A-3B, the sucker rod string 24 is rotated in the release direction while slowly picking up on the sucker rod string 24. For example, the housing 52 may need to be rotated 90 degrees to align the key head 72 with the slot 60 to unlock the tool 50. When the key head 72 is aligned with the slot 60, the key head 72 may be withdrawn from the slot 60. As a person of ordinary skill in the art understands, each revolution of the sucker rod string 24 at the surface does not necessarily translate to a full revolution of the sucker rod string 24 at depth due to the twisting of the sucker rod string 24. For example, about four or more revolutions at the surface may be necessary to rotate the housing 52 about 90 degrees when the tool 50 is deployed downhole. As the sucker rod string 24 is rotated in the release direction to disconnect the tool 50, the sucker rod string 24 may be over rotated. Over rotation of the housing 52 will cause the key head 72 to misalign with the slot 60 and will further cause the key 70 to ratchet within the housing 52. Ratcheting occurs when the end of the forks 58*f* rides over the top of the head 72, which allow the springs 56 to force the cam 58 back over the head 72 which prevents the head 72 from exiting the slot 60. Thus, the tool 50 may unlock and relock multiple times without the key head 72 exiting the slot 60. If the tool is over rotated, then the sucker rod string 24 will need further rotation to aligned the key head 72 with the slot 60 such that the upward force on the sucker rod string 24 is sufficient to begin the travel of the key head 72 within the slot 60. While the tool 50 shown in FIGS. 3A-3C has increased wear endurance by omitting the external clutch, multiple attempts may be necessary to unlock the tool 50 due to the ratcheting of the key 70 in the housing 52.

Thus, there exists a need in the art for a tool that can be reliably disconnected and reconnected downhole while having increased wear resistance.

SUMMARY

In one embodiment, an operating tool includes a housing including a key slot. The operating tool further includes at least one biasing member disposed in the housing. The operating tool further includes a key including a key head having a key profile, wherein the key head is remove from the slot when aligned with the key slot. The operating tool further includes a cam including a cam profile, wherein the cam is disposed in the housing and biased toward the slot by the at least one biasing member, wherein the cam profile is configured to engage the key profile to align the key head with the key slot.

In one embodiment, an operating tool includes a housing including a slot and a seat. The operating tool further includes at least one biasing member disposed in the housing. The operating tool further includes a key including a key head and a shoulder. The operating tool further includes a cam including a pocket, a first clutch profile, and a second clutch profile, wherein the cam is disposed in the housing and biased toward the slot by the at least one biasing member. When operating tool is in a locked configuration, the key head is misaligned with the slot and the key head is disposed in the pocket of the cam, wherein the shoulder is configured to engage the seat when the key head is misaligned with the slot. When the operating tool is in an unlocked configuration, the first clutch profile and the second clutch profile are engaged with the key head and the key head is aligned with the slot.

In one embodiment, a method of using an operating tool, comprising disconnecting the operating tool. Disconnecting the operating tool includes unlocking the operating tool by rotating a housing of the operating tool relative to a key of the operating tool, wherein the rotation of the housing relative to the key is limited by the engagement of a clutch profile of a cam disposed within the housing with a key head of the key, wherein the key head is aligned with a slot of the housing when the clutch profile is engaged with the key head. Disconnecting the operating tool further includes moving the housing relative to the key to withdraw the key head from the slot.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, may admit to other equally effective embodiments.

FIG. 1B illustrates an exemplary pump.

FIGS. 3A-3B are cross-sectional views of the conventional on-off tool. FIG. 3C is a perspective view with a portion of the housing cut away to reveal internal features.

FIGS. 4A-4B illustrate a cross-section of the tool. FIGS. 4C-4B are perspective views of the tool, with a portion of the housing cut away to reveal internal features.

FIGS. 5A-5B are different perspective views of the cam. FIG. 5C is a close-up view of the circled region in FIG. 5B.

FIG. 6C is a perspective view of the key head.

FIG. 7B is a cross-sectional view of the operating tool. FIGS. 7A, and 7C-7D are perspective views of the tool, with a portion of the housing cut away to reveal internal features.

FIGS. 8A-8C are perspective views of the tool, with a portion of the housing cut away to reveal internal features. FIG. 8A illustrates the on-off tool in the locked configuration. FIG. 8B illustrates the tool in the unlocked configuration. FIG. 8C illustrates a disconnected tool, with the key separated from the housing.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Figures 1A, 1B:
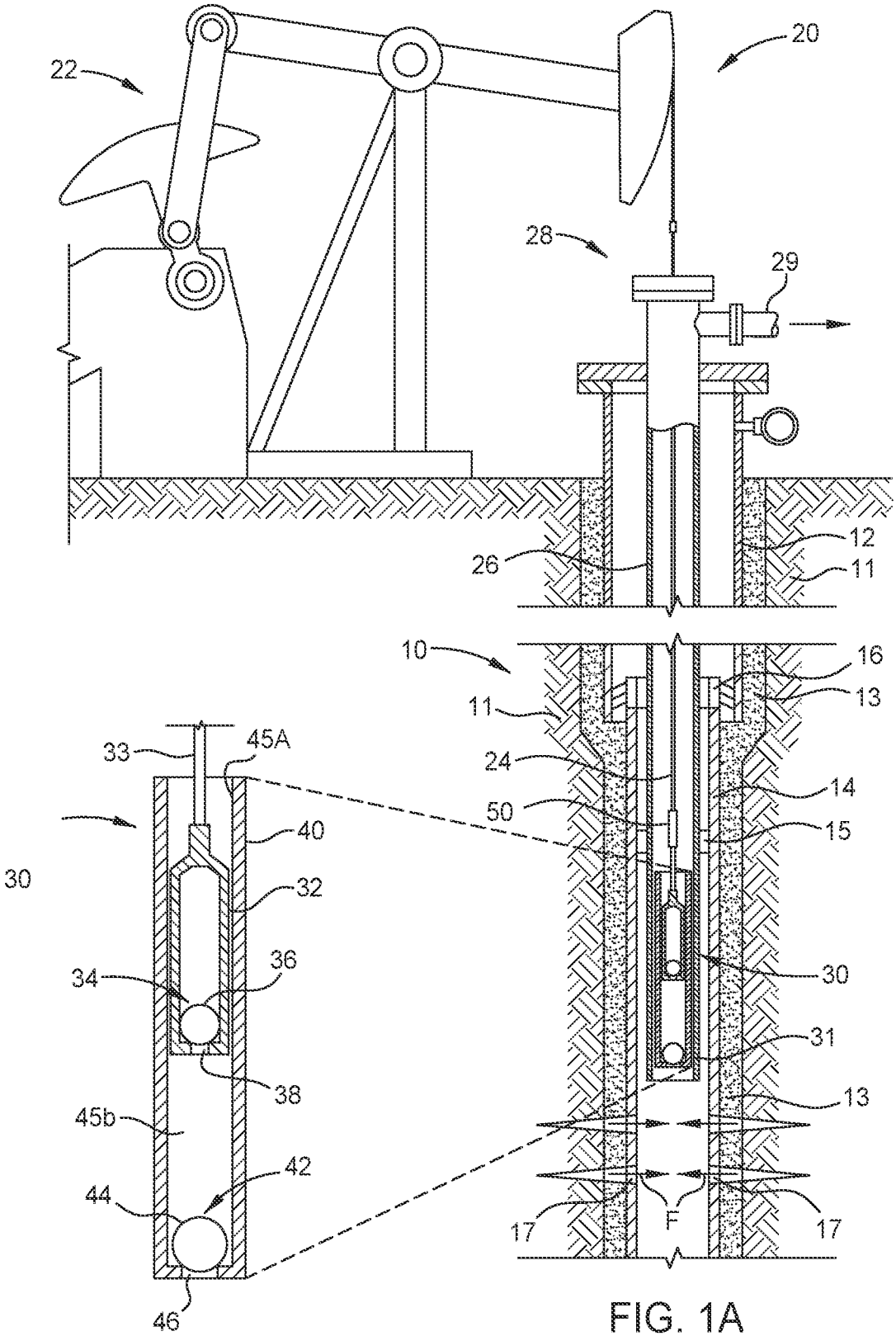
FIG. 1A (PRIOR ART)
FIG. 1B (PRIOR ART)
FIG. 1A-1B illustrates an artificial lift system.
Figure 2A:
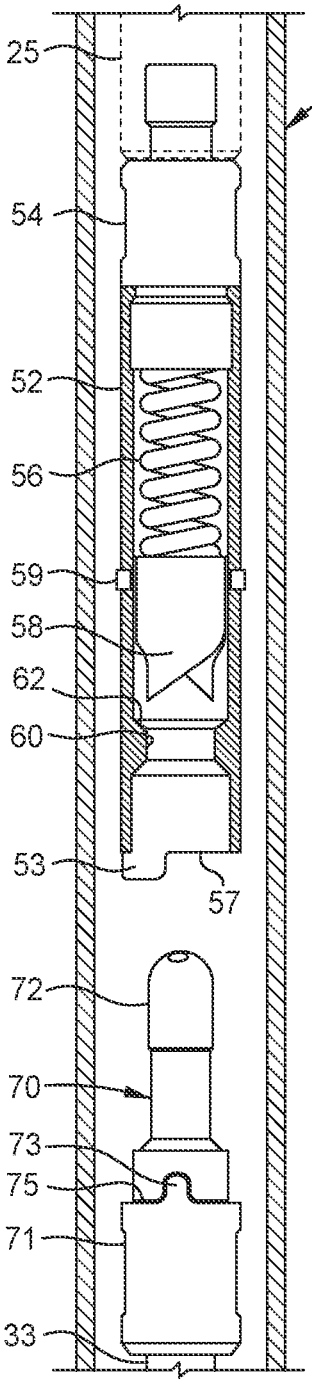
FIG. 2A (PRIOR ART)
FIGS. 2A-2D illustrate a conventional on-off tool with an external clutch disposed in a wellbore.
Figure 2B:
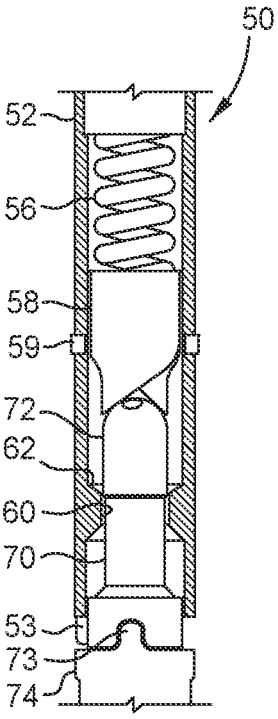
FIG. 2B (PRIOR ART)
Figure 2C:
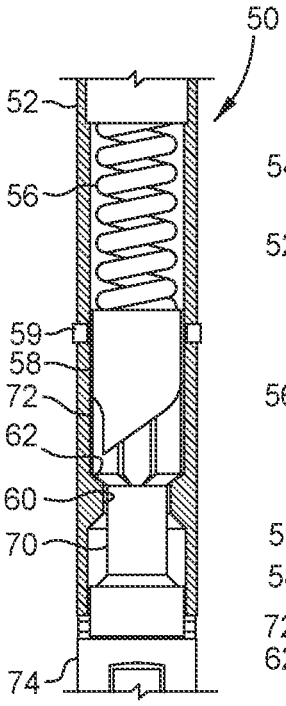
FIG. 2C (PRIOR ART)
Figure 2D:
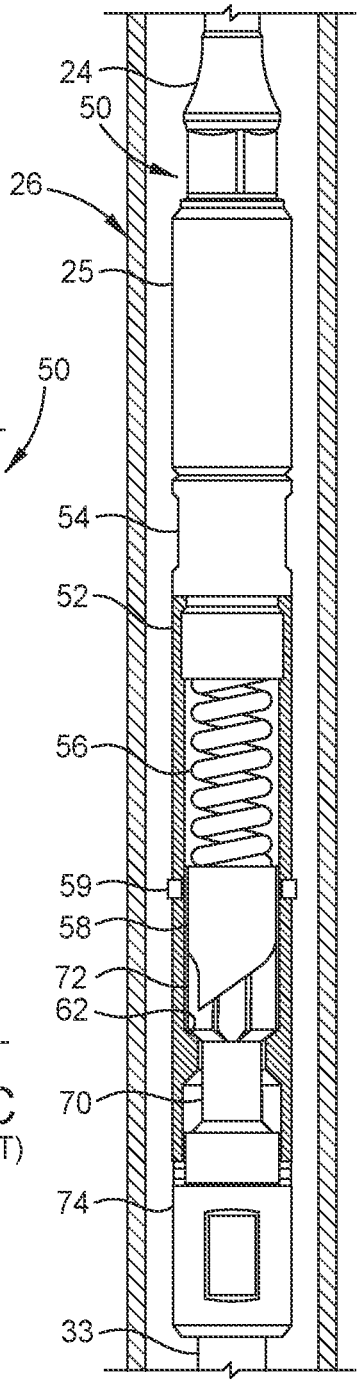
FIG. 2D (PRIOR ART)
Figure 3A:
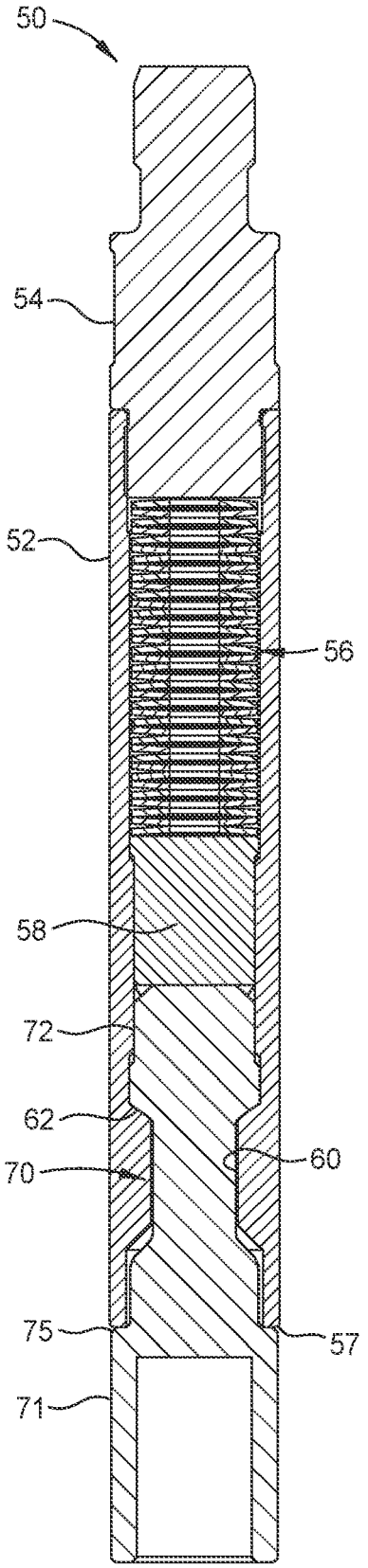
FIG. 3A (PRIOR ART)
FIGS. 3A-3C illustrate a conventional on-off tool without an external clutch.
Figure 3B:
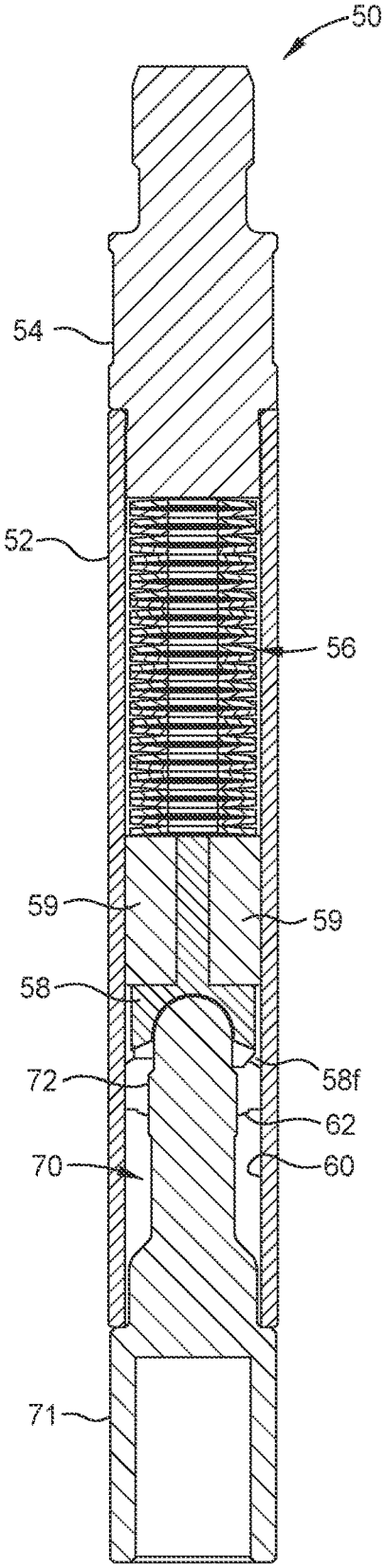
FIG. 3B (PRIOR ART)
Figure 3C:
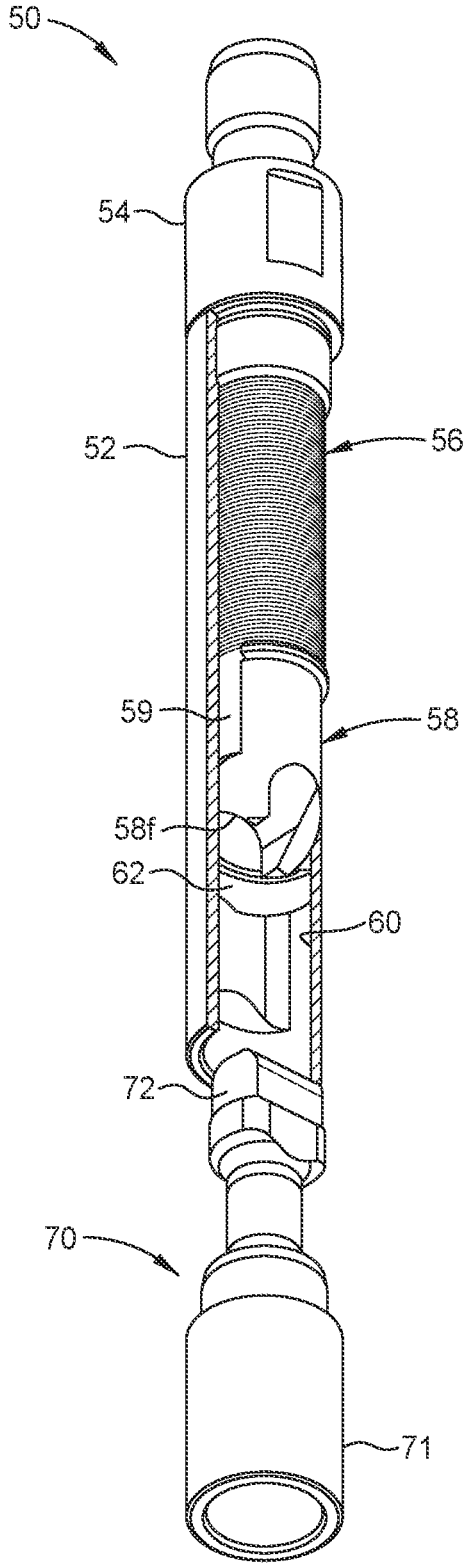
FIG. 3C (PRIOR ART)
Figure 4A:
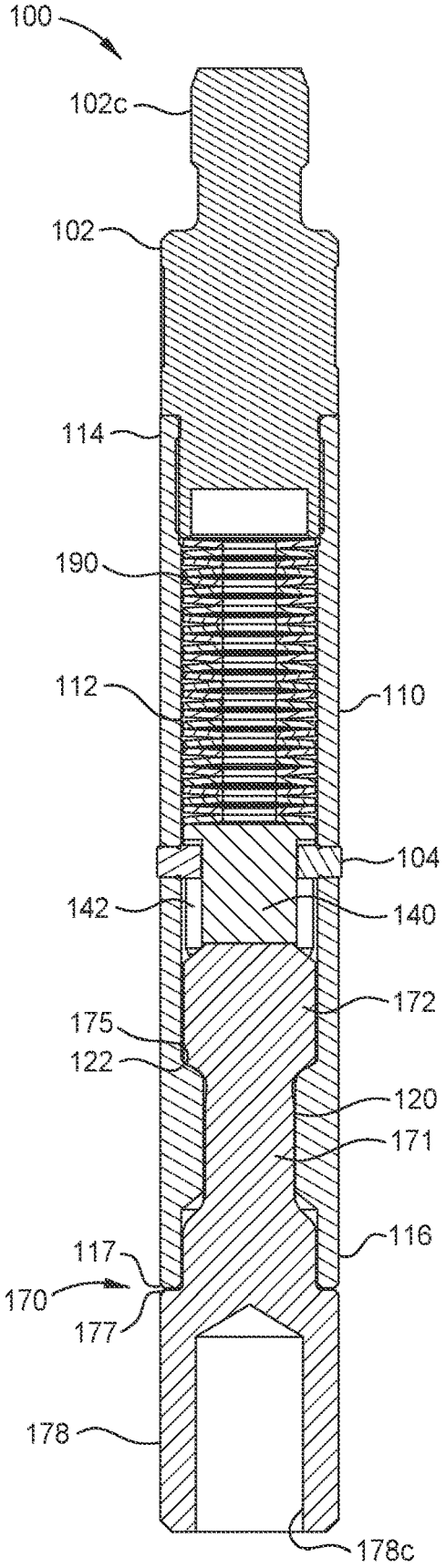
FIGS. 4A-4D illustrate an operating tool according to the present disclosure in a locked configuration.
Figure 4B:
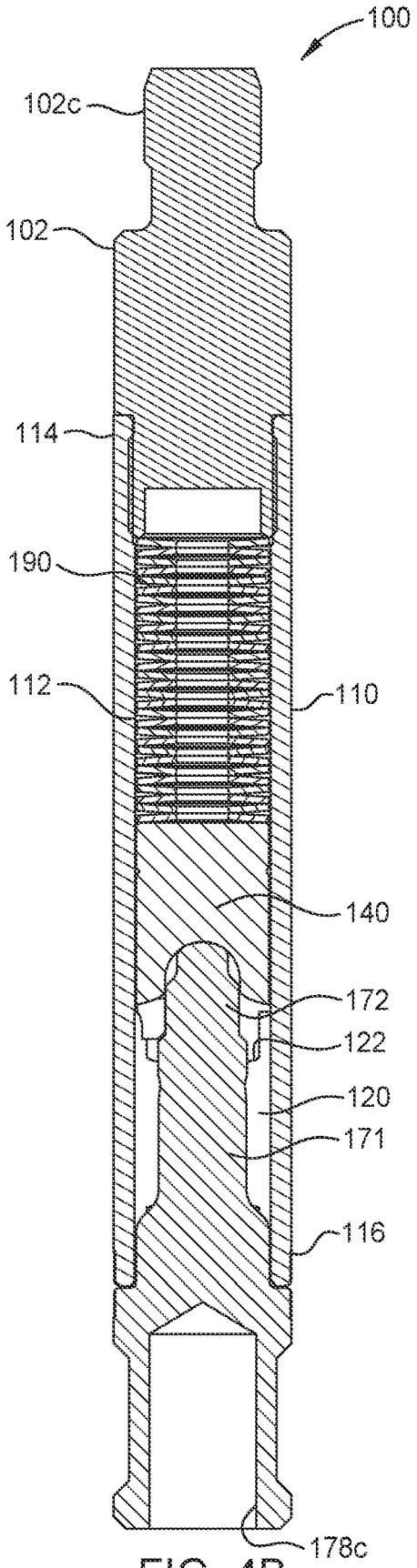
Figure 4C:
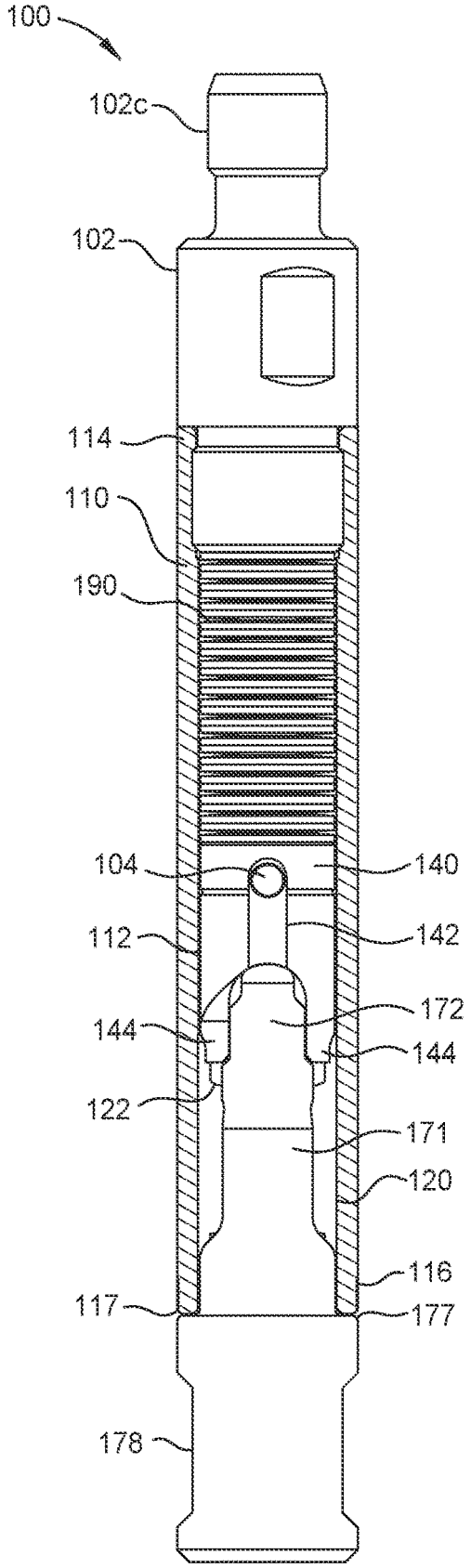
Figure 4D:
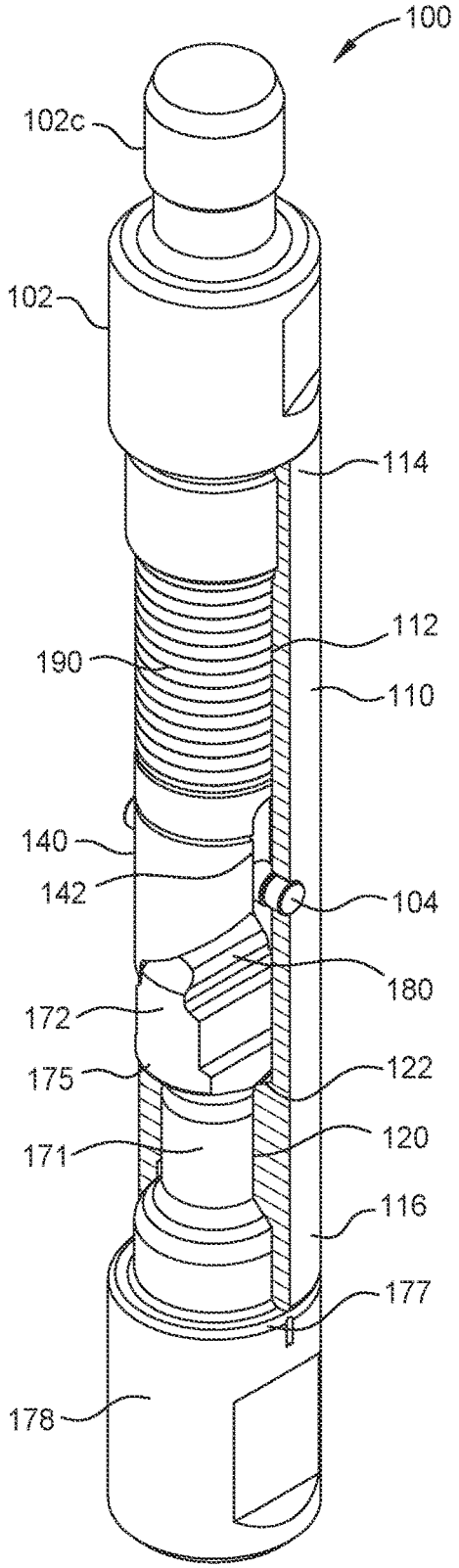

FIGS. 4A-4D illustrate an exemplary operating tool such as an on-off tool 100, according to one embodiment. In this embodiment, the on-off tool 100 including a housing 110, a cam 140, and a key 170. As will be described herein, the tool 100 has an internal clutch profile 152 that prevents over rotation during disconnection. As will be described herein, the tool 100 may also have a uniform shoulder contact area between the key 170 and housing 110 to improve the wear resistance and durability of the tool 100. The tool 100 can be used for connecting a sucker rod string 24 to a plunger rod 33 of a pump 30 of an artificial lift system, such as the artificial lift system 20 previously discussed with reference to FIGS. 1A-1B. FIGS. 4A-4B illustrate a cross-sectional view of the tool 100. FIGS. 4C and 4D illustrate a perspective view of the tool 100 with a portion of the housing 110 omitted to better show the internal components of the tool 100.

The tool 100 may include a fitting 102, guide pins 104, the housing 110, the cam 140, the key 170, and one or more biasing members 190. The biasing member 190 may be a plurality of disk springs as shown in FIGS. 4A-4D. In some embodiments, the biasing member 190 is one or more coiled springs.

The housing 110 has first and seconds end portions 114, 116 and defines an interior 112. The first end portion 114 connects to the fitting 102. The interior 112 defines a key slot 120 at the second end portion 116 of the housing 110. The key slot 120 terminates at a seat 122 within the housing 110. The second end portion 116 also includes an end shoulder 117.

Figure 5A:
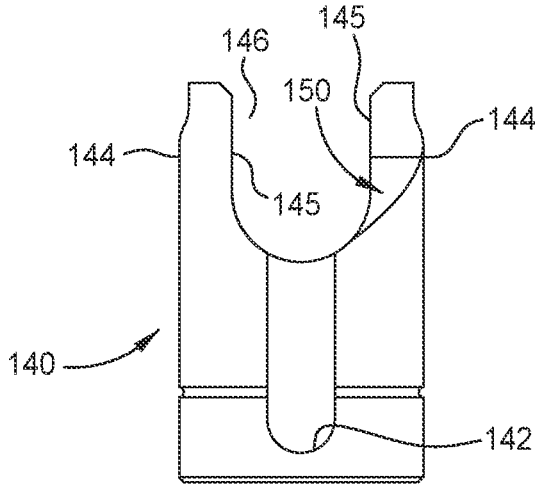
FIGS. 5A-5C illustrate a cam of the operating tool of the present disclosure.
Figure 5B:
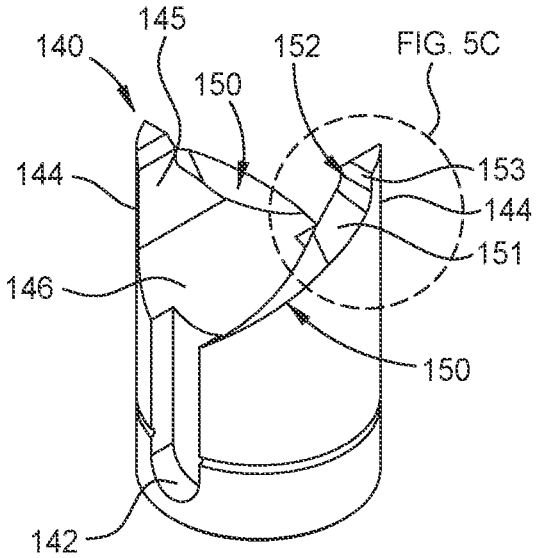
Figure 5C:
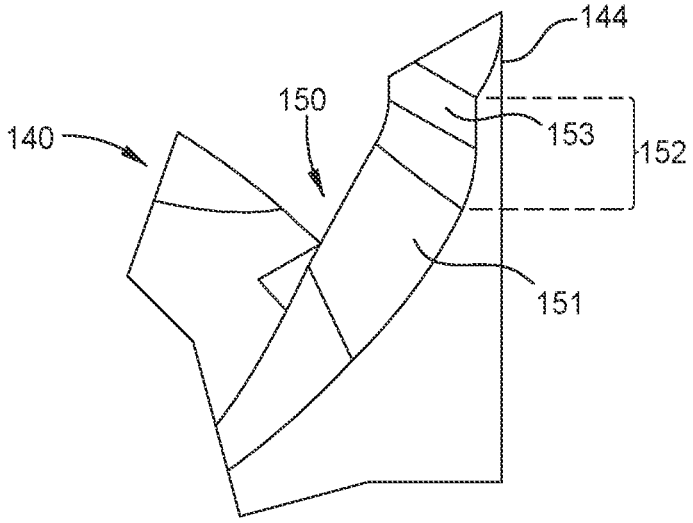

FIGS. 5A-5C also illustrate the cam 140. The cam 140 is disposed in the interior 112 of the housing 110. The cam 140 may be machined. In some embodiments the cam 140 includes two forks 144. The cam 140 may also include a slot 142 on opposing sides corresponding to the guide pins 104. The cam 140 further includes a pocket 146 between the forks 144 to receive a head 172 of the key 170. The cam 140 is longitudinally moveable within the housing 110. The biasing member 190 biases the cam 140 towards the second end portion 116. As the cam 140 moves longitudinally within the housing, a guide pin 104 rides in a respective slot 142. The travel of the cam 140 towards the second end portion 116 is limited by the abutment of the guide pins 104 with the end of the slots 142. The cam 140 is rotationally locked to the housing 110 by the interaction of the slots 142 with the guide pins 104.

Each fork 144 includes an interior surface 145 and a cam profile 150 having a helical progression along the fork 144. The cam profile 150 includes a lock profile 151 and a clutch profile 152. In some embodiments, and as shown in FIG. 5A-5C, the clutch profile 152 includes a curved surface adjacent a clutch shoulder 153. The clutch shoulder 153 may be a flat face. The clutch shoulder 153 is configured to engage a profile 180 of the key 170 to align the key 170 with the slot 120 during an unlocking operation of the tool 100. Additionally, the clutch shoulder 153 is configured to prevent the key 170 from ratcheting within the housing 110 due to an over rotation of either the housing 110 or the key 170 relative to one another. The lock profile 151 may have two or more pitches such that the profile 180 of the head 172 travels longitudinally relative to the housing at a different rate per unit of rotation. The lock profile 151 cooperates with the profile 180 when the tool 100 is connected to reduce the instances of unintended unlocking of the tool 100 when in use downhole. To disconnect the tool 100, sufficient torque applied to the housing 110 or key 170 to cause the cam 140 to slide along the profile 180 against the biasing force of the biasing member 190 as the key head 172 is aligned with the slot 120. An increased slope of the lock profile 151, such as a steep slope of the pitch, increases the amount of torque necessary to disconnect the tool 100. Therefore, the lock profile 151 is configured to lock the key 170 to the housing 110 until sufficient torque is applied to disconnect the tool 100. The differing pitches of the lock profile 151 may correspond to differing torque thresholds of the tool 100, such as a torque necessary to disconnect the tool 100. In some embodiments, the two or more pitches of the lock profile 151 may accommodate the insertion and locking of the key head 172 within the spatial constraints of the housing 110 and the longitudinal range of movement of the cam 140 within the housing 110.

Figure 6A:
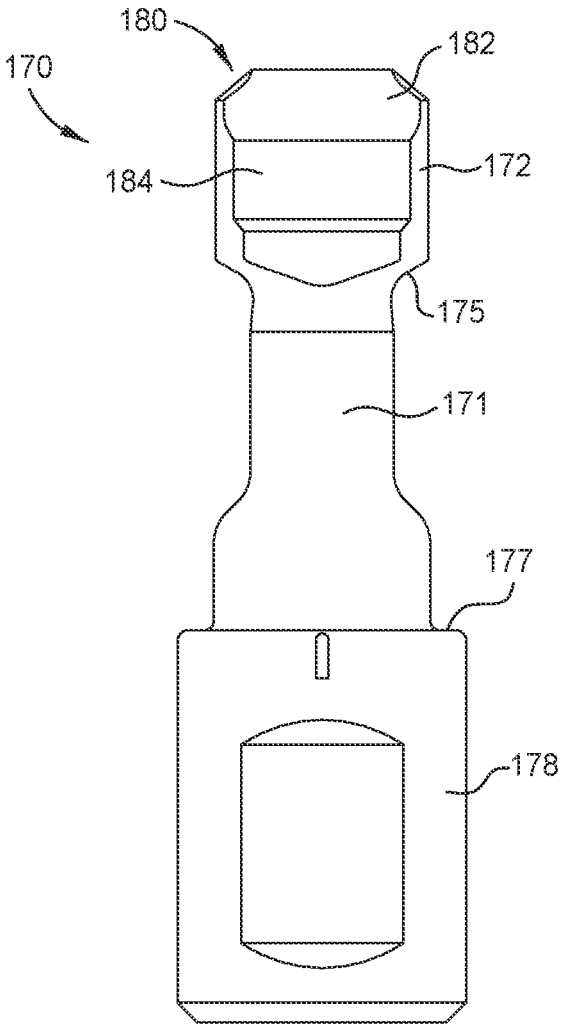
FIGS. 6A-6C are perspective views of a key of the operating tool of the present disclosure.
Figure 6B:
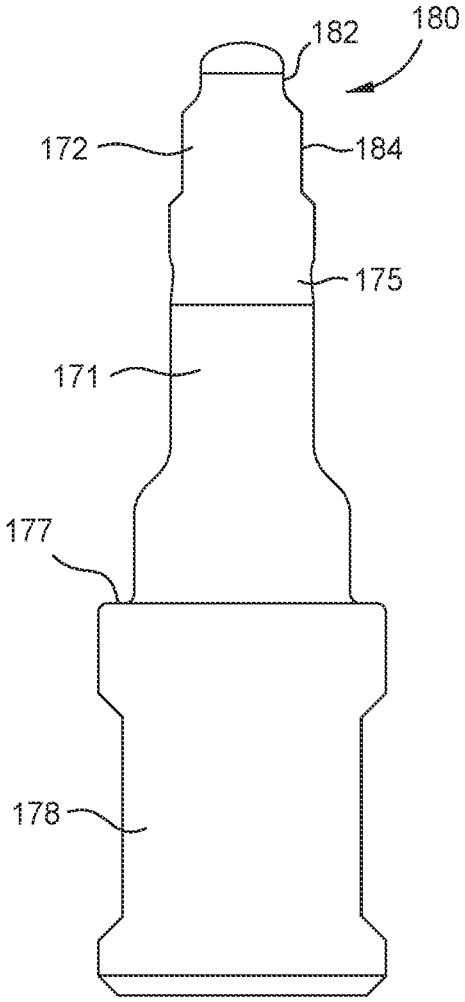
Figure 6C:
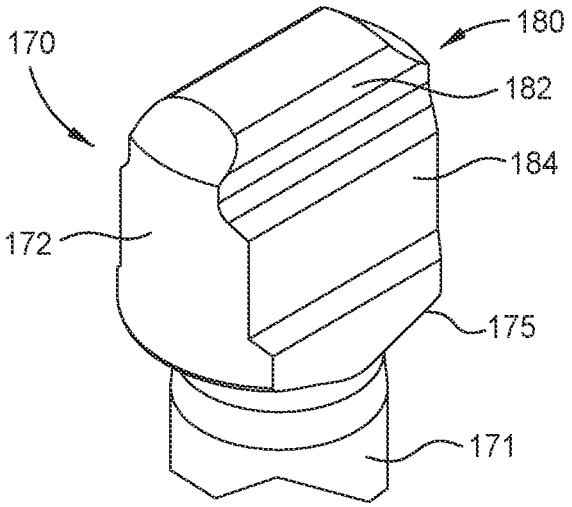
Figure 7A:
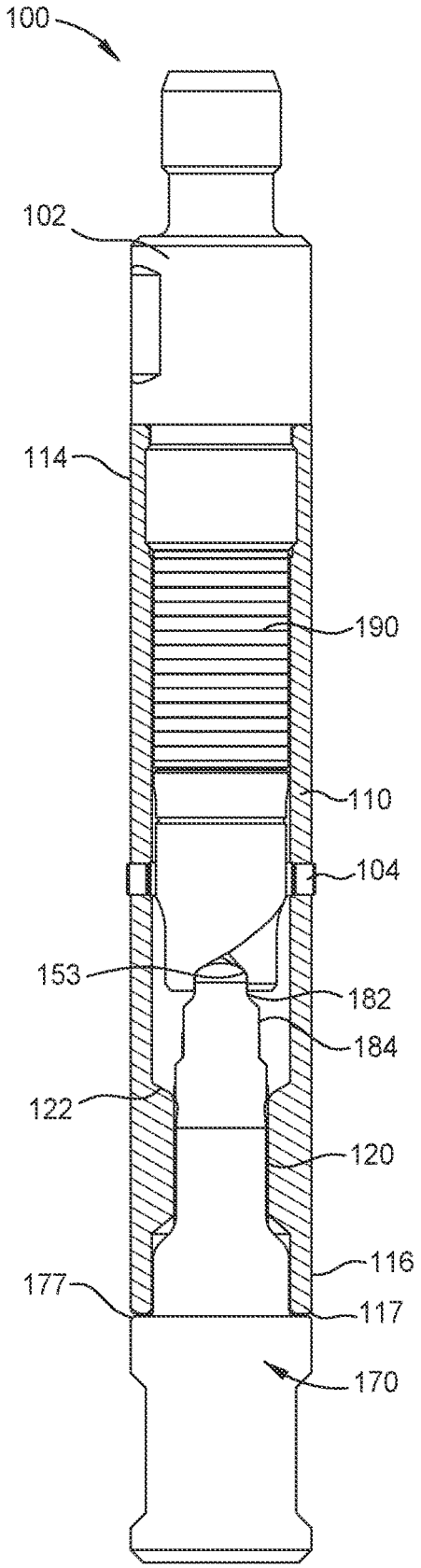
FIGS. 7A-7D illustrate the key engaged with the clutch profile of the cam.
Figure 7B:
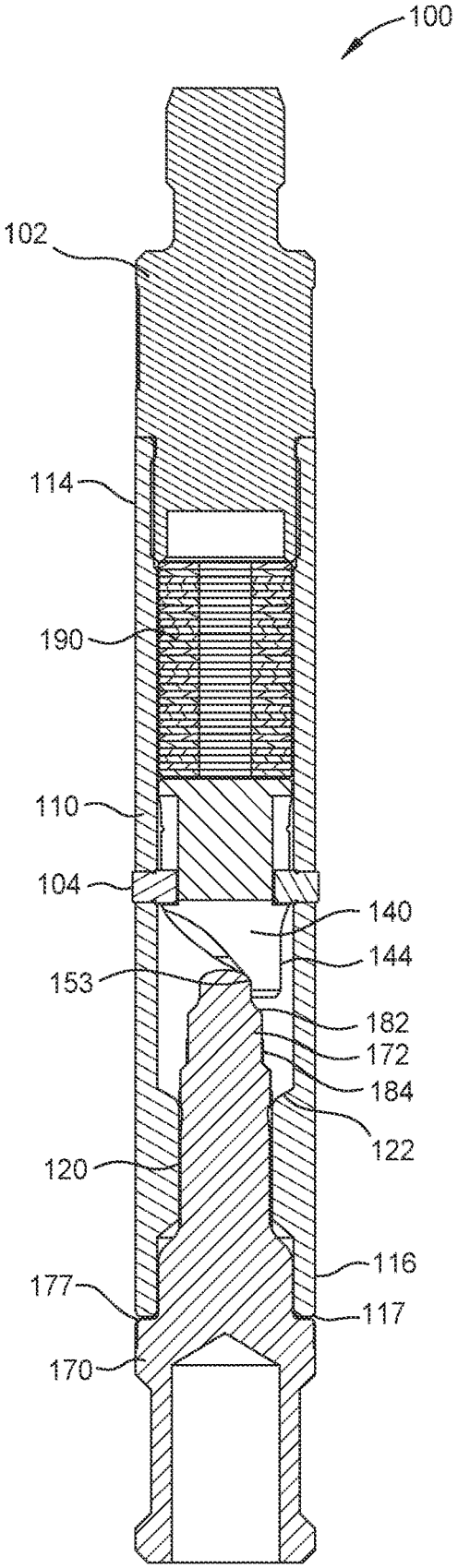
Figure 7C:
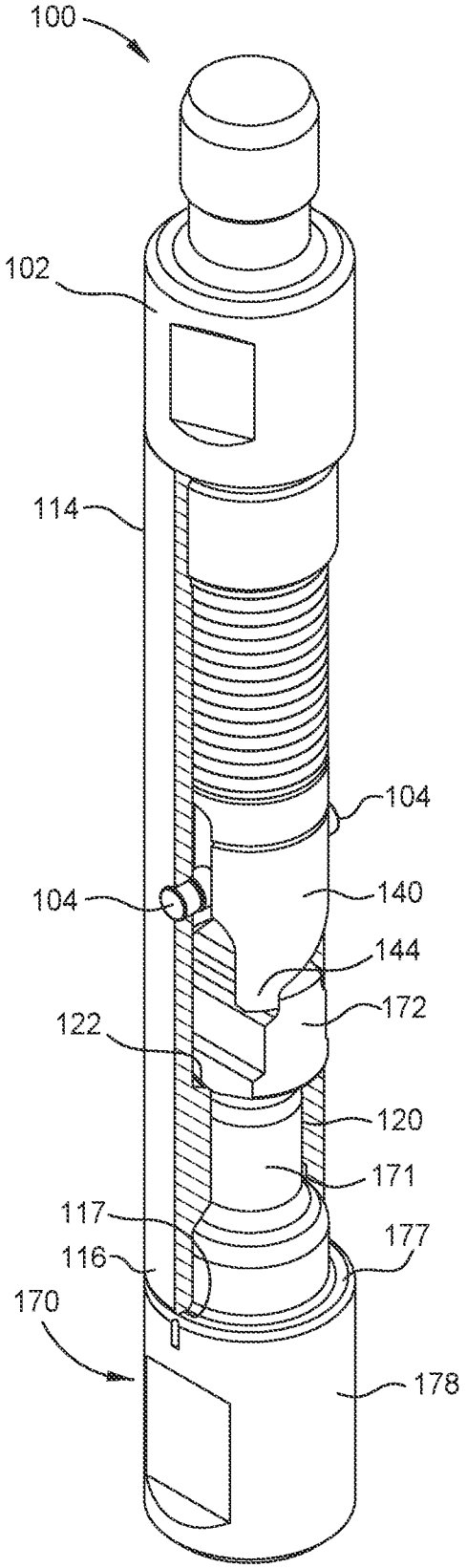
Figure 7D:
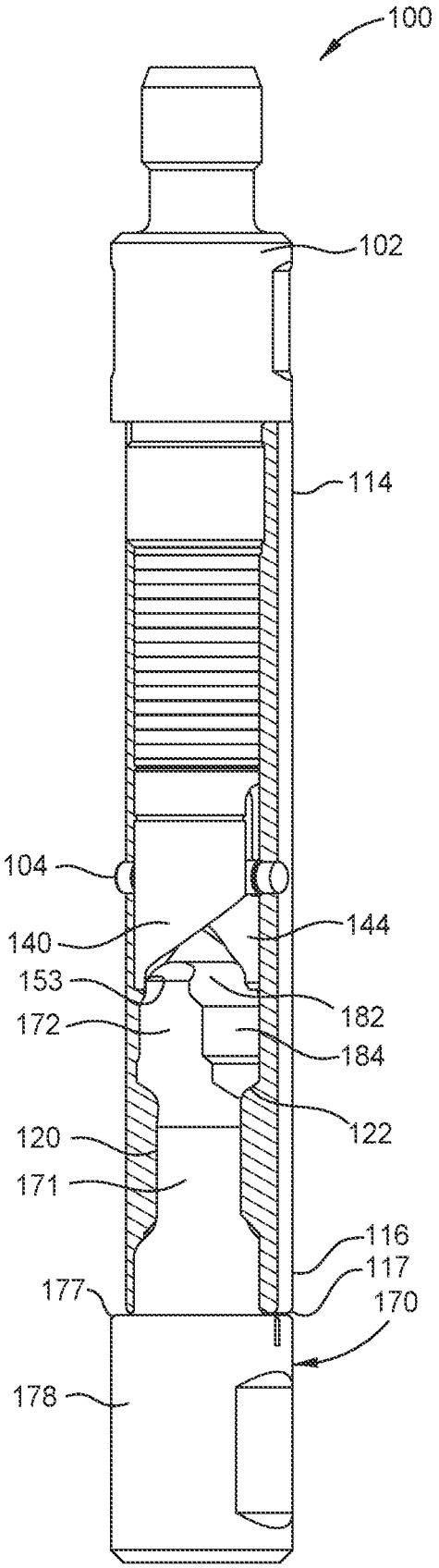

The key 170 is shown in FIGS. 6A-6C. The key 170 includes a stem 171, a head 172, and a base 178. The stem 171 is disposed between the head 172 and the base 178. The head 172 includes the profile 180 on opposing sides of the head 172. The end of the head 172 may be rounded as shown in the figures. The head also includes shoulder 175 corresponding to the seat 122. The head 172 has an oblong cross-section that corresponds to the slot 120. The base 178 may include a shoulder 177 that corresponds to the shoulder 117 of the housing 110. The base 178 may further include a connector, such as a box connector 178*c*, to facilitate the connection of the key 170 to the plunger rod 33.

The head 172 is configured to be inserted or removed the housing 110 once aligned with the slot 120. When the head 172 is inserted into the housing 110 past the slot 120, either the housing 110 or the key 170 may be rotated, such as clockwise by 90 degrees, to misalign the head 172 with the slot 120 to lock the key 170 to the housing 110. When the key 170 is locked to the housing 110, the shoulder 175 may engage the seat 122. The engagement of the seat 122 with the shoulder 175 transfers tensile forces during operation of the tool 100. Additionally, the shoulders 117 and 177 may be engaged when the tool 100 is in the connected. The shoulders 117 and 177 may have uniform surface areas. The cooperation of the shoulders 117, 177 may reduce wear of the shoulders 117, 177 as they contact one another during use of the tool 100 to improve the wear resistance and durability of the tool 110.

FIG. 6C illustrates a perspective view of the key head 172 which includes the profile 180. The profile 180 may have a first profile portion 182 and a second portion 184. As shown, the first profile portion 182 is the outer surface of the key head 172 near the tip of the key head 172. The first profile portion 182 is configured to engage the cam profile 150. The cam profile 150 and the first profile portion 182 interact to guide the head 172 into the pocket 146 during the locking of the key 170 to the housing 110. The second portion 184, such as a face, is configured to engage the interior surface 145 of a fork 144.

FIGS. 4A-4D illustrate the tool 100 in a locked configuration. When the key 170 is locked to the housing 110, the tool 100 is connected. Prior to disconnecting the tool 100 (i.e., separating the key 170 from the housing 110), the tool 100 is unlocked. To unlock the tool, either the housing 110 or key 170 is rotated to align the key head 172 with the slot 160 such that the key head 172 may be withdrawn from the slot 160 to disconnect the tool 100.

FIGS. 7A-7D illustrate the engagement of the clutch profile 152 with the first profile portion 182 of the profile 180. This engagement of the clutch profile 152 occurs during the insertion of the key 170 into the housing 110. The clutch profile 152 is the first point of contact of the head 172 with the cam 140 when the head 172 is initially inserted into the slot 120. Continued insertion of the head into the slot 120 will overcome the biasing force of the biasing member 190, causing the cam 140 to travel longitudinally within the housing 110 to accommodate the insertion of the key head 172. When unlocking the tool 100, the tool will return to this position. Thus, FIGS. 7A-7D also show the tool 100 in an unlocked configuration. As the tool 100 is unlocked, the key head 72 will reengage the clutch profile 152 to align the key head 172 with the slot 120.

The tool 100 may be connected at its fitting 102 to a sucker rod string 24 with a coupling 25 and may be connected at its key 170 to the plunger rod 33 of a pump 30. For example, fitting 102 may be connected to the coupling 25 by a pin connector 102*c* and the key 170 may be connected to the plunger rod 33 via the box connector 178*c*. In some embodiments, the key 170 will be connected to the sucker rod string 24 and the fitting 102 may be connected to the plunger rod 33. As will be detailed below, locking and unlocking of the tool 100 is achieved through the interaction of the key 170 with the housing 110 and cam 140 biased by the biasing members 190.

To connect the tool 100, the key 170 is inserted into the housing 110 via the slot 120. As the key 170 is inserted into the housing 110 via the slot 120, the head 172 will engage the cam 140. The first profile portion 182 contacts the cam profile 150, such as contacting the clutch profile 152 as shown in FIGS. 7A-7D. Continued insertion of the key 170 will overcome the biasing force of the biasing member 190, causing the cam 140 to travel longitudinally within the housing 110 to accommodate the insertion of the key head 72. Once the head 172 is fully inserted into the housing 110, either the key 170 or the housing 110 may be rotated a number of degrees, such as clockwise 90 degrees, to misaligned the head 172 with the slot 120. Misalignment of the head 172 with the slot 120 also facilitates the expansion of the biasing member 190 to slide the cam 140 over the key head 172. As either the housing 110 or key 170 is rotated, the cam profile 150 will slide along the profile 180 as the expansion of the biasing member 190 causes the cam 140 to travel within the housing 110. The key head 172 will be guided along the cam profile 150 such that the key head 172 is housed within the pocket 146 of the cam 140 when the tool 100 is in the locked configuration as shown in FIGS. 4A-4D. The biasing force of the biasing member 190 and the weight of the string 24 may be sufficient to slide the cam 140 over the key head 172 which applies torque sufficient to rotate the key 170 into misalignment with the slot 120. For example, as the housing 110 is rotated, the biasing force and weight may cause the key head 172 to rotate into misalignment with the slot 120. In some embodiments, upon insertion of the key head 172 into the slot 120, the biasing member 190 expands and the cam 140 slides over the key head 172 causing the key 170, and the plunger rod 33, to rotate into misalignment of the slot 120 without rotating the sucker rod string 24 at the surface.

The key 170 is locked within the housing 110 because it cannot be withdrawn from the slot 120 due to the engagement of the shoulder 175 and the seat 122. The cam 140, the key head 172, and the biasing member 190 interact to maintain the misalignment of the key 170 with the slot 120 until an unlocking operation is performed.

Figure 8A:
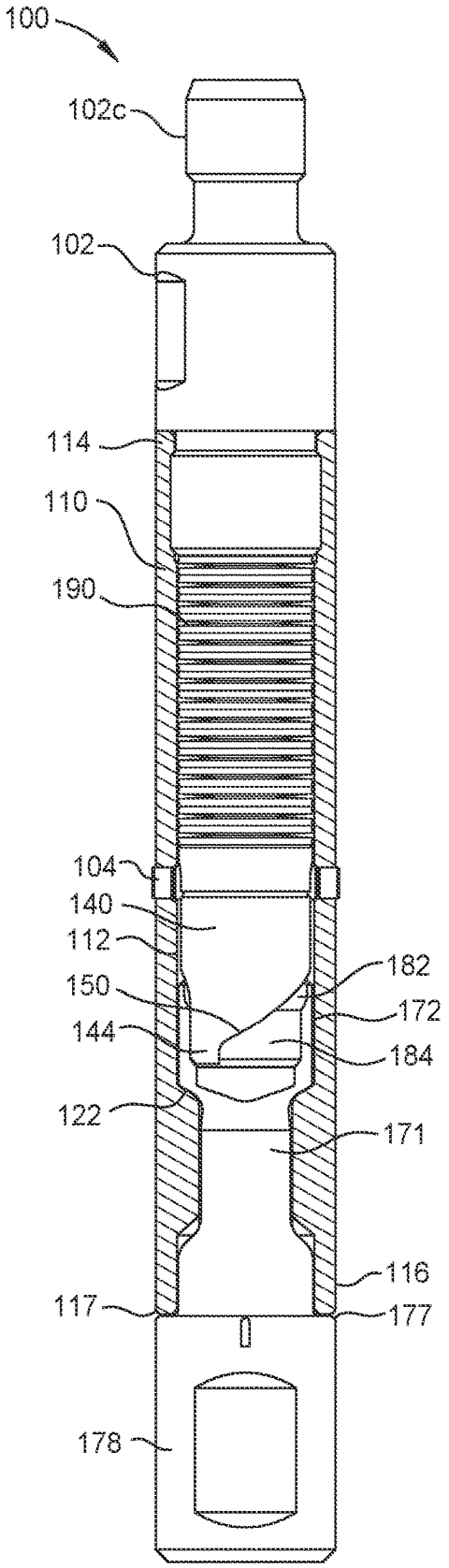
FIGS. 8A-8C illustrate the unlocking of the operating tool of the present disclosure.
Figure 8B:
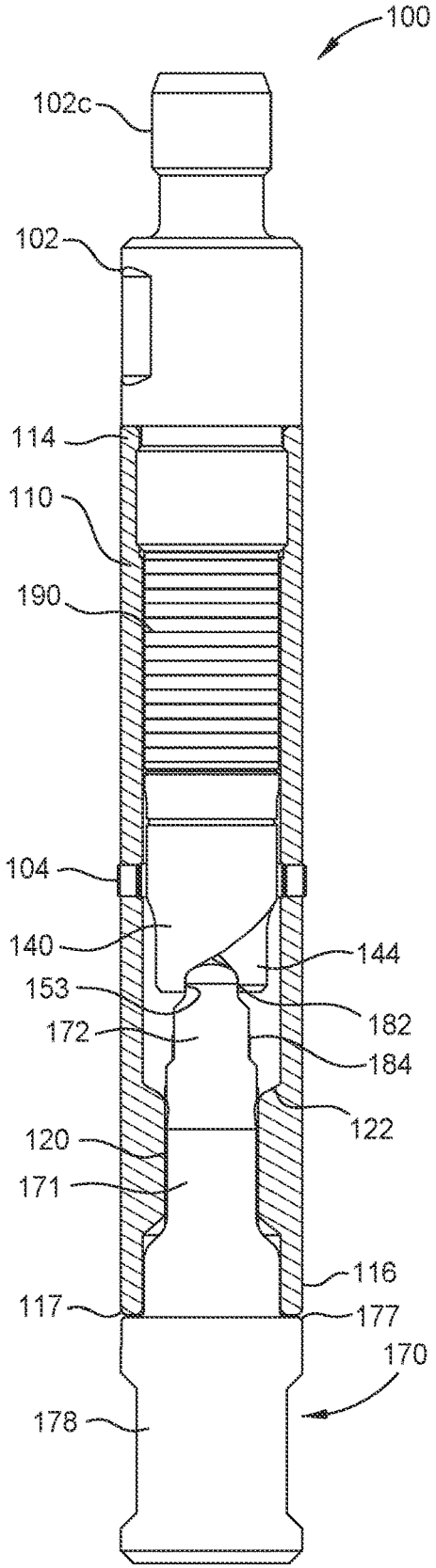
Figure 8C:
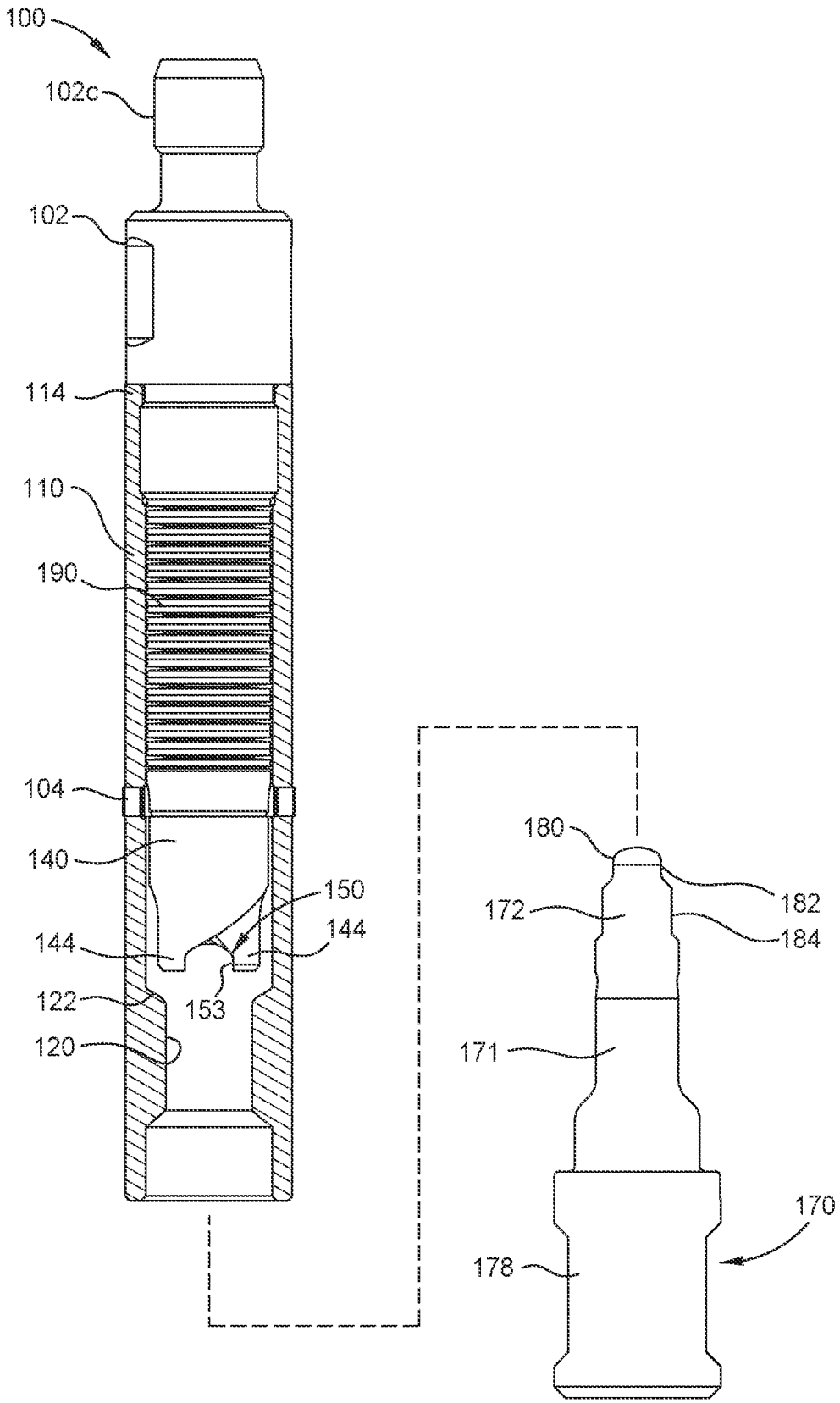

FIGS. 8A-8C illustrate an unlocking operation. As shown in FIG. 8A, the tool 100 is in the locked configuration. To unlock the tool 100, the key head 172 needs to be aligned with the slot 120. The pump 30 may be set on the bottom of the stroke prior to the beginning of the unlocking operation. Either the housing 110 or the key 170 is rotated relative to the other to unlock the tool 100. To rotate the housing 110 or key 170, the sucker rod string 24 may be rotated in the release direction. The sucker rod string 24 may be slowly picked up as it is rotated. In some embodiments, the housing 110 may be rotated 90 degrees counterclockwise relative to the key 170 to align the key head 172 with the slot 120. A torque is applied to overcome the locking force of the biasing member 190 and the lock profile 151. As the housing 110 rotates, the cam profile 150 slides along the profile 180 of the key head 172 which causes the cam 140 to move longitudinally and compresses the biasing member 190. The rotation of the housing 110 is limited by the engagement of the clutch profile 152 with the first profile portion 182. The abutment of the clutch profile 152 with the first profile portion 182 prevents further travel of the profile 180 along the cam profile 150. FIG. 8B illustrates the tool 100 in the unlocked configuration, with the profile 180 engaged with the clutch profile 152. The abutment of the clutch shoulder 153 with the first profile portion 182 transfers torque applied to the housing 110 to the key head 172. Thus, the abutment of the clutch shoulder 153 with the profile prevents the key 170 from over-rotating in the housing 110 and aligns the key head 172 with the slot 120 allowing for ease of tool 100 disconnection.

Once the tool 100 is unlocked, the tool 100 may be disconnected as shown in FIG. 8C. For example, the sucker rod string 24 may be raised to lift the housing 110 off the key 170. The housing 110 may be raised to the surface.

In some embodiments, the key 170 is connected to the sucker rod string 24 while the housing 110 is connected to the pump plunger 33. In some embodiments, the key 170 may be rotated by the sucker rod string 24 relative to the housing 110 to unlock or lock the tool 100.

In some embodiments, the on-off tool 100 may be used to connect and disconnect with a downhole tool that is not a pump.

In one embodiment, an operating tool includes a housing including a key slot. The operating tool further includes at least one biasing member disposed in the housing. The operating tool further includes a key including a key head having a key profile, wherein the key head is remove from the slot when aligned with the key slot. The operating tool further includes a cam including a cam profile, wherein the cam is disposed in the housing and biased toward the slot by the at least one biasing member, wherein the cam profile is configured to engage the key profile to align the key head with the key slot.

In some embodiments of the operating tool, the cam profile includes a clutch shoulder, wherein the clutch shoulder is configured to engage the key profile to align the key head with the key slot.

In some embodiments of the operating tool, the cam profile includes a lock profile.

In some embodiments of the operating tool, the lock profile has two or more pitches.

In some embodiments of the operating tool, the key profile includes a first profile portion and a second profile portion, wherein the clutch shoulder is configured to engage the first profile portion to align the key head with the key slot.

In some embodiments of the operating tool, the at least one biasing member is a plurality of disk springs.

In some embodiments of the operating tool, the housing includes a uniform shoulder configured to engage a uniform shoulder of the key.

In some embodiments of the operating tool, the cam includes a first fork and a second fork, wherein the cam profile is a first cam profile of the first fork, wherein the second fork includes a second cam profile.

In some embodiments of the operating tool, the operating tool further comprising at least one guide pin disposed in a corresponding slot of the cam.

In one embodiment, an operating tool includes a housing including a slot and a seat. The operating tool further includes at least one biasing member disposed in the housing. The operating tool further includes a key including a key head and a shoulder. The operating tool further includes a cam including a pocket, a first clutch profile, and a second clutch profile, wherein the cam is disposed in the housing and biased toward the slot by the at least one biasing member. When operating tool is in a locked configuration, the key head is misaligned with the slot and the key head is disposed in the pocket of the cam, wherein the shoulder is configured to engage the seat when the key head is misaligned with the slot. When the operating tool is in an unlocked configuration, the first clutch profile and the second clutch profile are engaged with the key head and the key head is aligned with the slot.

In some embodiments of the operating tool, the first clutch profile includes a first clutch shoulder and the second clutch profile includes a second clutch shoulder, wherein the first clutch shoulder and the second clutch shoulder are engaged with the key head in the unlocked configuration of the operating tool.

In some embodiments of the operating tool, the cam includes a first lock profile and a second lock profile.

In some embodiments of the operating tool, the first lock profile and the second lock profile have two or more pitches.

In some embodiments of the operating tool, the at least one biasing member is a plurality of disk springs.

In some embodiments of the operating tool, the housing includes a uniform shoulder configured to engage a uniform shoulder of the key.

In some embodiments of the operating tool, the operating tool further comprising at least one guide pin disposed in a corresponding slot of the cam.

In some embodiments of the operating tool, the housing is connectable to a sucker rod string and the key is connectable to a pump.

In one embodiment, a method of using an operating tool, comprising disconnecting the operating tool. Disconnecting the operating tool includes unlocking the operating tool by rotating a housing of the operating tool relative to a key of the operating tool, wherein the rotation of the housing relative to the key is limited by the engagement of a clutch profile of a cam disposed within the housing with a key head of the key, wherein the key head is aligned with a slot of the housing when the clutch profile is engaged with the key head. Disconnecting the operating tool further includes moving the housing relative to the key to withdraw the key head from the slot.

In some embodiments, the method of using the operating tool further includes connecting the operating tool after disconnecting the operating tool. Connecting of the operating tool includes inserting the key head into the slot, wherein the key head engages the clutch profile and the cam moves longitudinally relative to the housing away from the slot against the biasing force of at least one biasing member. Connecting the operating tool further includes rotating the housing to lock the key to the housing, wherein the biasing member causes the cam to travel longitudinally toward the slot as the housing is rotated until the key head is disposed in a pocket of the cam and misaligned with the slot, wherein a shoulder of the key head is engageable with a seat of the housing when the key is locked to the housing.

In some embodiments of the method of using the operating tool, the cam profile includes a clutch shoulder, wherein the rotation of the housing relative to the key is limited by the engagement the clutch shoulder with the key head.

While the foregoing is directed to embodiments of the present disclosure, other and further embodiments of the disclosure may be devised without departing from the basic scope thereof, and the scope thereof is determined by the claims that follow.

What is claimed is:

1. An operating tool, comprising:

a housing including a slot and a seat;

at least one biasing member disposed in the housing;

a key including a key head and a shoulder; and a cam including a pocket, a first clutch profile, and a second clutch profile, the first clutch profile including a first clutch shoulder, the second clutch profile including a second clutch shoulder, wherein the cam is disposed in the housing and biased toward the slot by the at least one biasing member;

wherein:

when the operating tool is in a locked configuration, the key head is misaligned with the slot and the key head is disposed in the pocket of the cam, wherein the shoulder is configured to engage the seat when the key head is misaligned with the slot; and when the operating tool is in an unlocked configuration, the first and second clutch shoulders of the first clutch profile and the second clutch profile are engaged with the key head and the key head is aligned with the slot.

2. The operating tool of claim 1, wherein the cam includes a first lock profile and a second lock profile.

3. The operating tool of claim 2, wherein the first lock profile and the second lock profile have two or more pitches.

4. The operating tool of claim 3, wherein the two or more pitches are configured to vary longitudinal movement between the cam and the key head relative to rotation between the cam and the key head.

5. The operating tool of claim 1, wherein the at least one biasing member is a plurality of disk springs.

6. The operating tool of claim 1, wherein the housing includes a uniform shoulder configured to engage a uniform shoulder of the key.

7. The operating tool of claim 1, further comprising at least one guide pin disposed in a corresponding slot of the cam.

8. The operating tool of claim 1, wherein the housing is connectable to a sucker rod string and the key is connectable to a pump.

9. The operating tool of claim 1, wherein the key head comprises a first profile portion disposed toward a distal end of the key head and comprises a second profile portion disposed between the first profile portion and the shoulder, wherein in the unlocked configuration, the first and seconds clutch shoulders engaged with the first profile portion are configured to transfer torque applied to the housing to the key head and are configured to prevent the housing from over-rotating on the key when aligning the slot with the key head.

10. The operating tool of claim 1, wherein the first and second clutch profiles include curved surfaces adjacent the first and second clutch shoulders; and wherein each of the first and second clutch shoulders define a flat face.

11. The operating tool of claim 1, wherein the key head comprises:

a distal end;

opposing sides extending along a longitudinal axis of the key between the distal end and the shoulder;

first profile surfaces disposed on the opposing sides of the key head and disposed toward the distal end, the first profile surfaces being parallel to the longitudinal axis of the key and being separated by a first separation on the opposing sides; and second profile surfaces disposed on the opposing sides of the key head and disposed between the first profile surfaces and the shoulder, the second profile surfaces being parallel to the longitudinal axis of the key and being separated by a second separation on the opposing sides, the second separation being greater than the first separation.

12. The operating tool of claim 11, comprising curved transitions disposed between the first and second profile surfaces on each of the opposing sides of the key head.

13. The operating tool of claim 1, wherein the key head comprises a first profile portion disposed toward a distal end of the key head and comprises a second profile portion disposed between the first profile portion and the shoulder, wherein the first and second clutch shoulders are configured to engage the first profile portion to align the key head with the slot.

14. The operating tool of claim 1, wherein the cam includes a first fork having the first clutch profile and includes a second fork having the second clutch shoulder.

* * * * *